US006679730B2

(12) United States Patent
Dye et al.

(10) Patent No.: US 6,679,730 B2
(45) Date of Patent: Jan. 20, 2004

(54) CONNECTOR WITH OVERMOLD SEAL/ROBUST LATCH

(75) Inventors: David Eugene Dye, Rancho Santa Margarita, CA (US); James Francis McIntire, West Linn, OR (US); Scott Jeffrey Thiel, Sherwood, OR (US); Brian Erik Haug, Portland, OR (US)

(73) Assignees: ITT Manufacturing Enterprises, Inc., Wilmington, DE (US); Precision Interconnect, A Ludlow LP Company, Wilsonville, OR (US)

( * ) Notice: Subject to any disclaimer, the term of this patent is extended or adjusted under 35 U.S.C. 154(b) by 0 days.

(21) Appl. No.: 10/159,318

(22) Filed: May 29, 2002

(65) Prior Publication Data

US 2003/0224661 A1 Dec. 4, 2003

(51) Int. Cl.[7] ..... H01R 13/58

(52) U.S. Cl. ..... 439/606; 439/589; 439/275

(58) Field of Search ..... 439/606, 589, 439/352, 357, 344, 345, 936, 587; 15/143.1

(56) References Cited

U.S. PATENT DOCUMENTS

| | | | | |
|---|---|---|---|---|
| 5,593,320 A | * | 1/1997 | Konda et al. | 439/589 |
| 6,338,657 B1 | * | 1/2002 | Harper et al. | 439/692 |
| 6,361,342 B1 | * | 3/2002 | Cox | 439/275 |
| 6,511,337 B1 | * | 1/2003 | Fandrey et al. | 439/320 |

* cited by examiner

*Primary Examiner*—Alexander Gilman
(74) *Attorney, Agent, or Firm*—Roger C. Turner

(57) ABSTRACT

A connector assembly with front and rear bodies (50, 40) and a surrounding shell (12), has a potting material (72) that is molded around the cable (20) and within a rear body passageway (70) in a manner that avoids leakage of the potting material. The shell outside surface has outwardly-projecting ridges (124, 141–144) for effectively grasping the connector, and the front body is latchable to the shell with robust latch arms (174). An O-ring (80) lying forward of the threading connections (52, 54) of the bodies limits leakage of the potting material flowed under pressure into the passageway. The outer shell is molded with ridges (124, 141–144) extending in loops that facilitate correct gripping and avoid slipping of the thumb on the connector. The front body has slots (170, 172) forming latch arms that latch to openings in the shell, the arms being formed by slots with enlarged ends (190, 192).

15 Claims, 3 Drawing Sheets

CONNECTOR WITH OVERMOLD SEAL/ROBUST LATCH

BACKGROUND OF THE INVENTION

A common type of connector includes a front body with contact-holding passages, a rear body, and a shell that surrounds the bodies. A cable whose wire front ends are terminated to the rear ends of the contacts, extends through a passageway in the rear body and trails from the connector. The rear body can be filled with potting material around the cable to seal the connections to the contacts. However, when the potting material is injected from the rear of the rear body under pressure, the potting material tends to leak from the front of the rear body. Avoiding such leakage would be desirable.

A molded shell has a largely cylindrical surface that is grasped in a person's hand to push the shell forwardly and pull it rearwardly during mating and unmating. It would be desirable if the shell indicated to a person where he should grasp the shell, and provide high friction against slippage of the person's thumb with respect to the shell.

After the front and rear bodies are assembled around the cable, the body assembly is inserted forwardly into the shell and is latched therein by a pair of arms formed in a snap lock sleeve of the front body. The arms tend to break, and a construction that avoided such breakage would be of value.

SUMMARY OF THE INVENTION

In accordance with one embodiment of the present invention, a connector assembly is provided with pressure sealed potting material around the cable, with a grip around the shell that indicates how the shell should be held and which avoids slippage, and with rugged latch arms that latch the body assembly to the shell. The body assembly includes front and rear bodies that are joined together by a threaded connection, and with potting material injected under pressure into the passageway along which the cable extends through and out the rear of the connector. An O-ring lying immediately forward of the threaded connection, provides a seal against leakage of pressured potting material when the potting material is still flowable.

The shell is molded or cast and has an outside surface that avoids slippage. The outside surface has at least one ridge on one side of the axis, the ridge extending in a loop and including opposite sides that extend largely parallel to the axis of the shell and a rear rib portion that connects the sides and that projects further radially outward than most of the area of the shell outside surface. Additional ridges extending in smaller loops preferably lie within the larger loop. The opposite side of the shell is devoid of ridges. This encourages a person to hold the shell with his thumb against the ridges, and avoids slippage especially when the shell is pulled rearwardly to unmate the connector from another mating connector.

The front body has a pair latch arms with projections that snap into openings in the shell to latch the body assembly to the shell. The latch arms are made more robust by forming each of the slots that forms one latch arm, with opposite ends that are enlarged, and preferably with the enlargements at opposite sides of each latch arm projecting towards each other beyond the rest of the slot.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
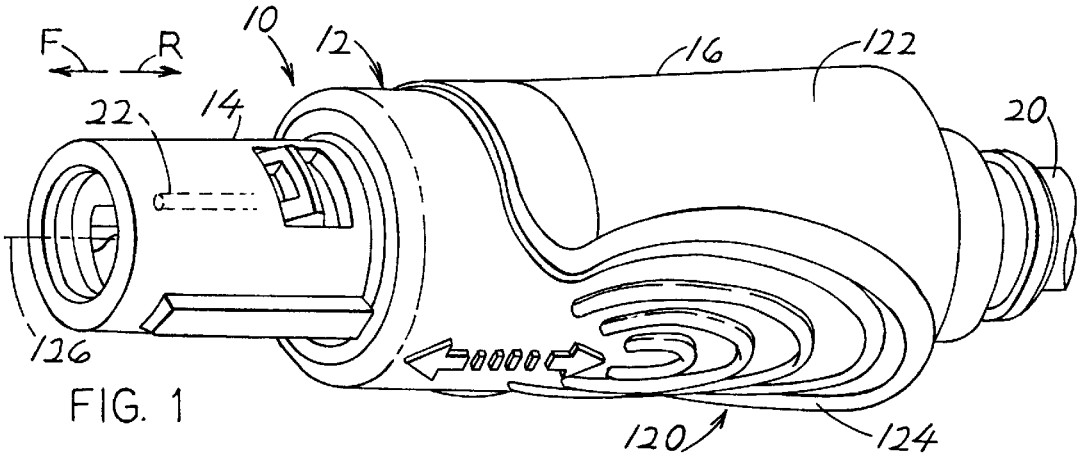
FIG. 1 is a front isometric upside-down view of a connector of the present invention.
Figure 5:
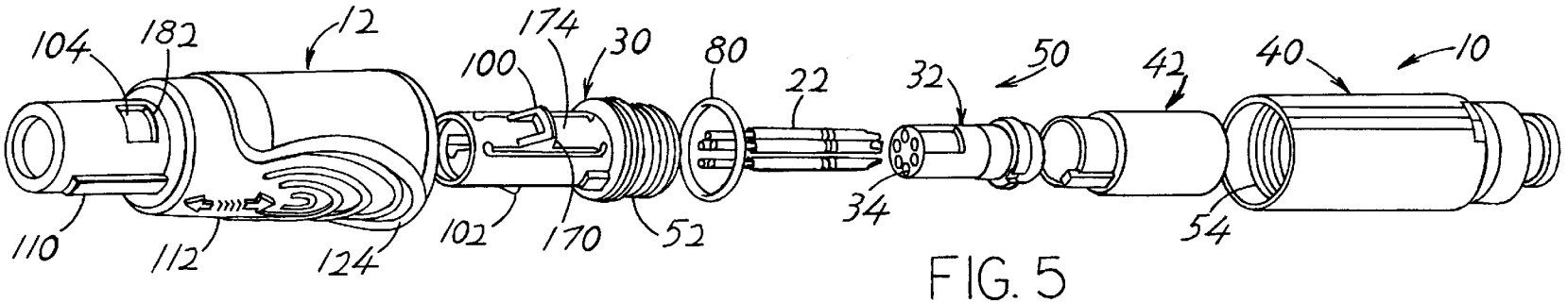
FIG. 5 is an exploded isometric view of the upside-down connector of FIG. 1.

FIG. 1 illustrates a connector 10 of the invention with a shell 12 having front and rear shell portions 14, 16. A cable 20 extending from the rear of the connector has wires that connect to contacts 22, and the connector is mated to another connector by moving the connector 10 forwardly F. FIG. 5 shows that the connector includes a front body 50 that includes a snap lock sleeve 30 and a contact holder 32 with passages 34 that hold the contacts 22. A rear body 40 lies rearward of the front body, and a wire-surrounding sleeve 42 lies largely within the rear body 40.

Figure 6:
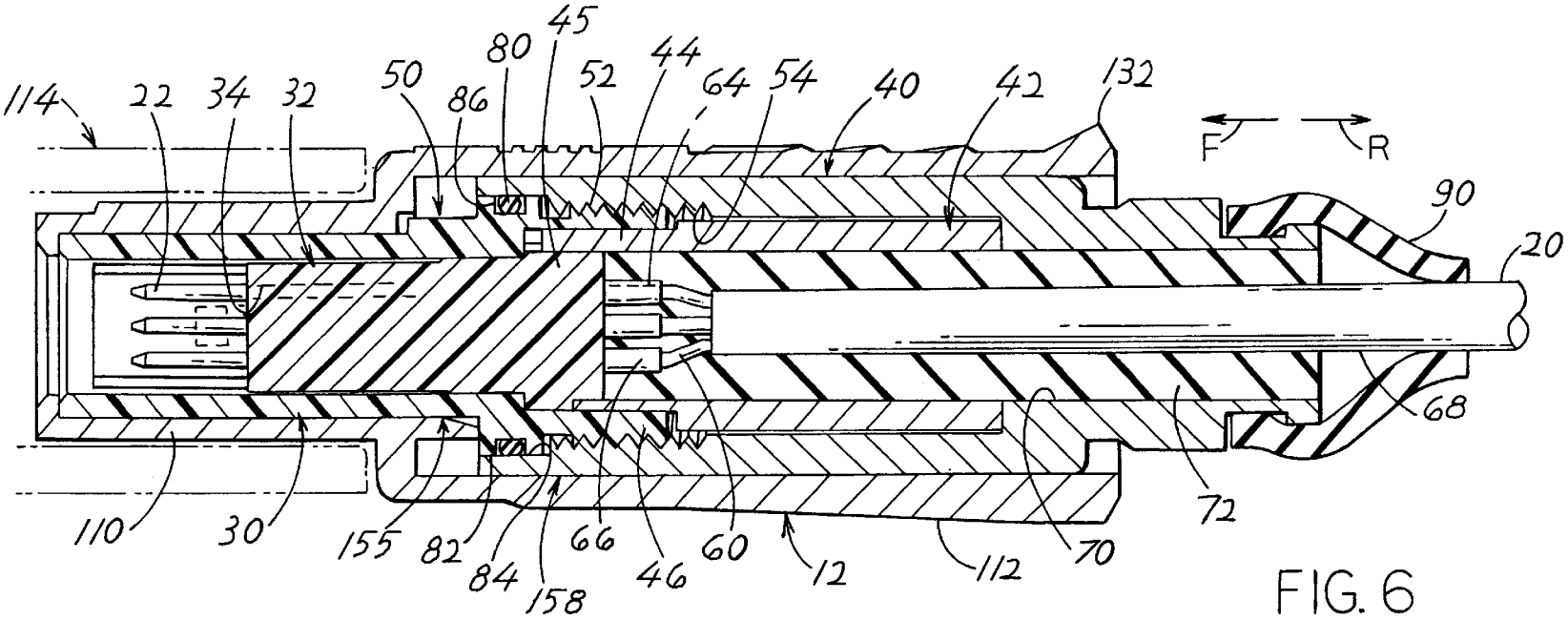
FIG. 6 is a sectional view of the connector of FIG. 1, with all parts assembled and the connector oriented right-side-up.
Figure 7:
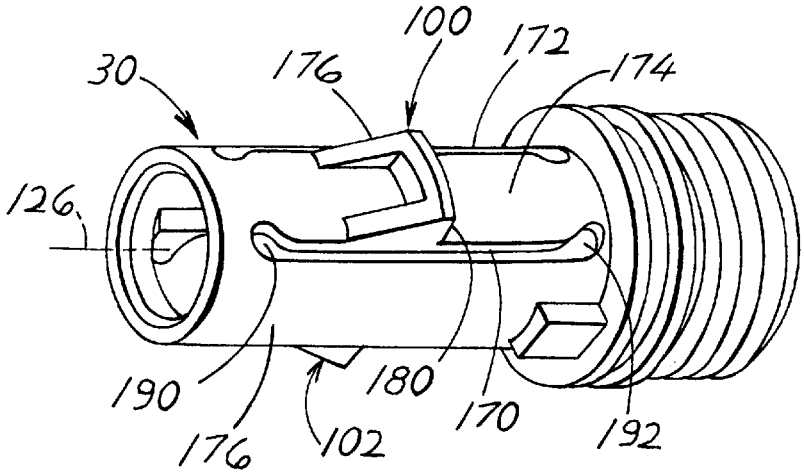
FIG. 7 is a front isometric view of the snap lock sleeve of the connector of FIG. 5.
Figure 8:
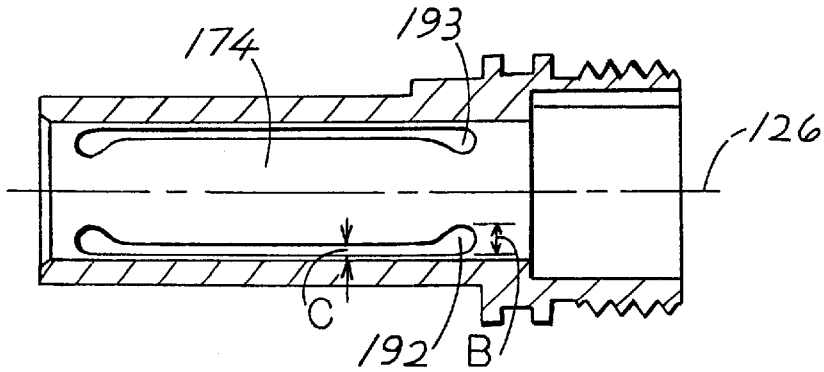
FIG. 8 is a sectional view of the sleeve of FIG. 7.
Figure 9:
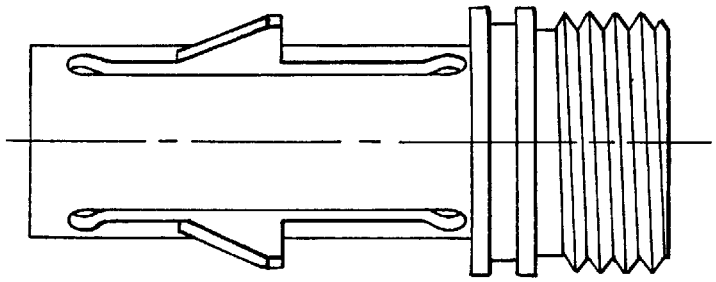
FIG. 9 is a side elevation view of the sleeve of FIG. 7.

FIG. 6 shows the parts assembled. The contacts 22 have been fixed in the passages 34 of the contact holder 32 and the contact holder lies within the snap lock sleeve 30. The holder 32 and sleeve 30 are part of a front body 50 that is attached to the rear body 40 by external threads 52 at the rear portion of the front body that are threadably engaged with internal threads 54 at the front portion of the rear body. Prior to such threadable attachment, wires 60 of the cable 20 have their conductors 64 bared, inserted into bores at the rear end portions of the contacts, and held in place as by crimping or soldering. The cable also includes a jacket 68 that lies around the wires.

After the cable wires have been terminated to the rear portions of the contacts, and the rear body 40 is threadably attached to the front body, the passageway 70 of the rear body is filled with a potting material 72. Although rigid potting materials such as epoxy could be used, applicant usually prefers to provides an elastomeric potting material such as silicone, to provide stress relief for the cable 20. That is, the elastomeric material deflects sidewardly when the cable 20 is pulled perpendicular to the forward F and rearward R directions. In most cases, the potting material is injected into the passageway under a pressure of at least 1 psi, and preferably about 9 psi. This assures that the potting material will reliably seal the areas around the rear contacts portions 66. Some of the potting material may leak around the rear portion 45 of the contact holder 32 and through the gaps between threads 52, 54. If a potting material such as epoxy is used, it can be applied without pressure.

Applicant provides an O-ring seal 80 between outer and inner cylindrical surfaces 82, 84 of the rear portion of the snap lock sleeve 30 and of the front portion of the rear body 40. The O-ring lies in a groove 86 formed in one of the cylindrical surfaces such as the inner surface. As a result, as the flowable potting material is injected under pressure into the passageway and leaks between the threads, the O-ring 80 prevents further leakage of the potting material. Leakage of the potting material could hinder or prevent motion between the shell 12 and the snap lock sleeve 30, resulting in the latching mechanism not functioning properly. After the potting material has solidified, a boot 90 may be applied between the rear of the rear body and the cable 20, especially if the potting material is rigid. In many cases, a flexible potting material forms a flexible boot, and a separate boot is not required.

Applicant provides the wire surrounding sleeve 42 with a front end 44 that lies closely between the outside of a rear portion 45 of the contact holder and the inside of the rear portion 46 of the snap lock sleeve ("close" means a clearance of no more then 0.02 inch between them). Any leaked potting material passes forward inside the wire surrounding sleeve front end and then rearward along the outside before reaching the threads 52, 54 and the O-ring 80.

Prior to insertion of the contacts and molding of potting material, the snap lock sleeve 30 will have been inserted forwardly F into the shell. Such insertion proceeds until two latches 100, 102 (FIG. 5) formed on the snap lock sleeve 30 of the front body, snap into latch-receiving openings 104 of the front portion 110 of the shell, which is of a smaller diameter than the rear portion 112 of the shell. The contacts and other parts are assembled and potting material is molded and allowed to solidify. The shell 12 with the cable trailing behind it, then can be mated to another connector indicated at 114 in FIG. 6, by grasping the shell and pushing it forwardly. Unmating of the connectors is accomplished by a person firmly grasping the shell rear portion 112 and pulling the shell rearwardly R. It is noted that for some purchasers of the connectors, the latch shoulders 80 are angled for easy unlatching, as by a rearward force of under five pounds. For other customers, a large rearward force is required for unlatching. In many cases, it is more difficult to achieve unmating than mating.

Figure 2:
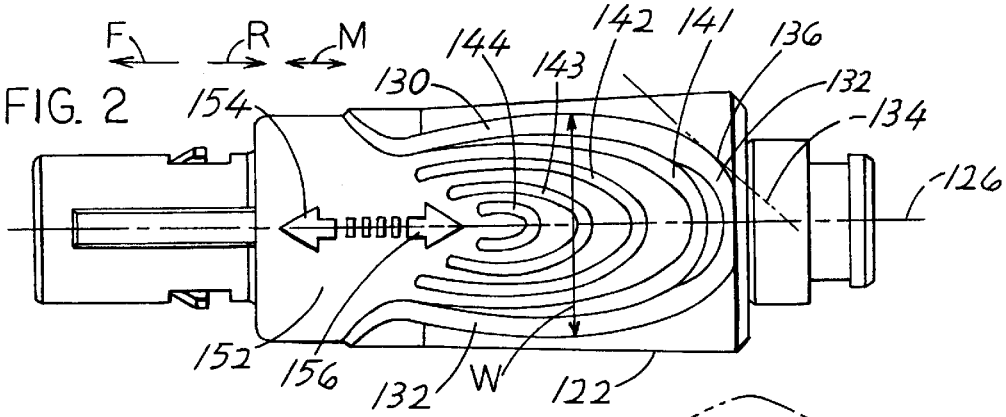
FIG. 2 is a top view of the connector of FIG. 1.
Figure 3:
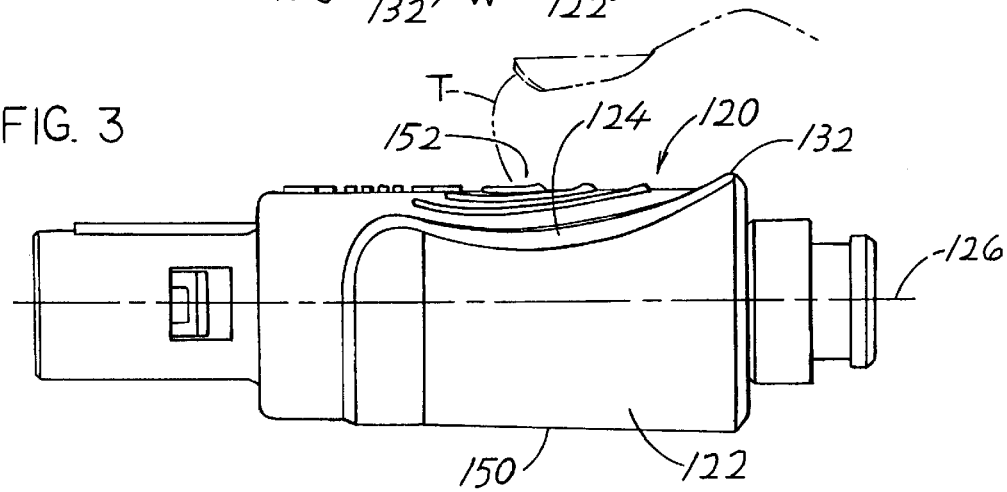
FIG. 3 is a side view of the connector of FIG. 1.
Figure 4:
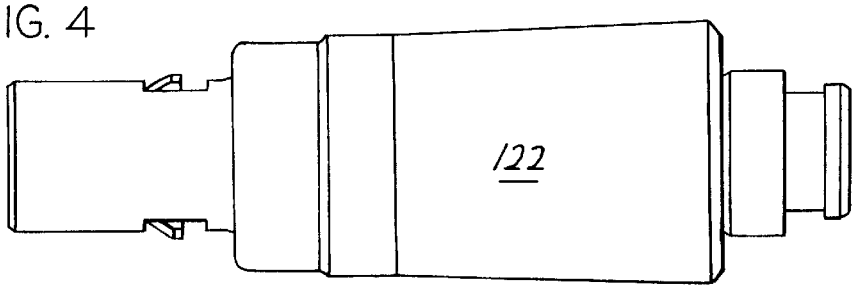
FIG. 4 is a bottom view of the connector of FIG. 1.

In order to prevent a person's fingers from slipping on the shell 12, especially during unmating, applicant forms a gripping surface portion shown at 120 in FIGS. 1–3. The gripping surface portion is formed on a largely cylindrical surface 122 at the shell rear portion, and includes a main rib or ridge 124 that projects radially outward (with respect to the shell axis 126) of the largely cylindrical surface 122. The ridge 124 (FIG. 2) extends in a loop, with ridge side portions 130, 132 extending primarily in front F and rear R longitudinal M directions, or parallel to the axis 126. The ridge also includes a largely circumferentially extending end ridge portion 132 that extends primarily circumferential to the axis 126. A line 134 that is 45° to the axis 126 is tangent to a point 136 between the side and end ridge portions 130, 132. Applicant provides additional ridges 141–144 that each extends in a loop parallel to the loop of the outermost or main ridge 124.

The main ridge sides are circumferentially spaced by an angle of about 120° about the axis 126. As shown in FIG. 3, an opposite side 150 of the shell rear portion which lies opposite the ridge 124, is devoid of ridges. The side 152 that contains the ridges, also contains front and rear directing arrows 154, 156 that indicate the direction and rotational position around the axis (e.g. the connector is pushed rather than rotated to mate). The mating connector can have a corresponding arrow, to indicate to the person that the connectors are to be mated with their arrows aligned.

As shown in FIG. 3, the rear end circumferentially-extending ridge portion 132 projects further from the axis 126 than other portions of the ridges. This provides support for the thumb T of a person who is grasping the connector. As indicated in FIG. 2, the ridge has a width W of about 2 centimeters so much of the thumb T can fit against the ridges.

As shown in FIG. 5 and as described earlier, the front and rear bodies are held together by engagement of the threads 52, 54, and the body assembly 158 (FIG. 6) is held in the shell by the latches 100, 102 (FIG. 5) of the snap lock sleeve that snap into the latch-receiving openings 104 in the front portion of the shell. FIGS. 7–10 illustrate details of the snap lock sleeve and of the latches 100, 102. The latches 100, 102 are identical, and lie on diametrically opposite sides of the axis 126, although three or even more latches could be provided in a larger connector. The latch 100 is formed by a pair of slots 170, 172 that extend parallel to the axis 126 and that form a latch arm 174 between them. The latch arm also carries a projection 176 that projects radially outward with respect to the axis 126 and that forms a rearwardly-facing shoulder 180. In FIG. 5, the rearwardly-facing shoulder 170 snaps into the shell opening 104 and lies forward of a forwardly-facing shell shoulder 182.

The slots such as 170 (FIG. 7) have front and rear ends 190, 192 that are closed ends resulting in a latch arm such as 174 which is not cantilevered but which has opposite ends merging with the rest 176 of the snap lock sleeve 30. This results in a stronger latch arm. However, the reduced flexibility can result in cracks developing in the sleeve, particularly at the opposite ends of the slots 170, 172. Applicant avoids concentrated stresses at the slot ends by forming enlarged slot ends 190, 192. That is, each slot end such as 192 has a width B (FIG. 8) in a circumferential direction, which is greater than the width C of the rest of the slot and of the average width of the slot. The width B is preferably more than twice as great as the width C. This results in stresses at the opposite ends of the slot being better distributed, and resulting in more robust latch arms. The enlargements in the slot ends such as 192 and 193 (FIG. 8) of the two slots that form one latch arm 174 between them, project toward one another. This reduces the width of the latch arm end, where much of the bending occurs, for greater flexibility.

Figure 10:
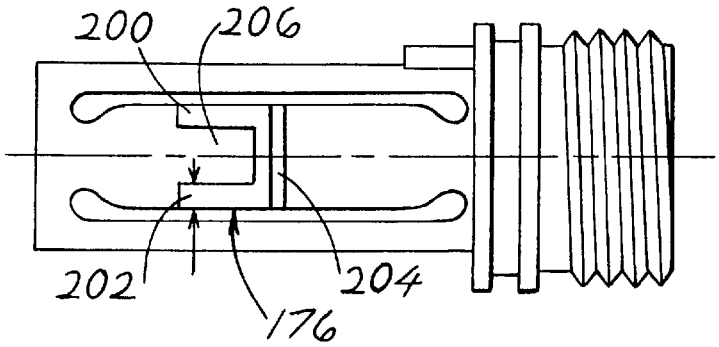
FIG. 10 is a plan view of the sleeve of FIG. 7.

The projection 176, shown in FIG. 10, has opposite side walls 200, 202 and a rear wall 204, with a gap 206 formed between the side ridges and rear wall 204. This construction reduces the amount of material and enables more even cooling of the injection molded snap lock sleeve. Previously, shrinkage occurred when the plastic molded material lay in the gap 206. The strength of the rear wall 204 against rearward movement, is adequate because the side walls 200, 202 adequately support the rear wall 204. The side walls 200, 202 extend at a radially outward and rearward incline.

Thus, the invention provides a connector assembly which includes front and rear bodies that are joined together, with contacts lying in passages of a contact holder, of the front body and with a cable extending through a passageway in the rear body, and with the assembly of front and rear bodies being latched in place in a surrounding shell. A potting material that is preferably elastomeric, is injected under pressure in a passageway of the rear body. Leakage is reduced by a wire-surrounding sleeve and by an O-ring that lies axially beyond threadably engaged ends of the bodies. The outside of the shell is molded with ridges at one side. A main ridge extends in a loop, and additional ridges that are smaller than the main ridge lie within the main ridge loop. The rear of the main ridge extends circumferentially and projects radially further than the rest of the ridges. The snap lock sleeve, which has latches to latch into openings in a front portion of the sleeve, has latch arms formed by slots with enlarged front and rear ends, and with a projection on each latch arm having a gap.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector assembly comprising front and rear bodies, said front body including a contact-holding portion with a plurality of contact-receiving passages and including a rear portion, said rear body having a rear portion forming a cable-receiving passageway and having a front portion connected to said front body, said electrical connector assembly including a plurality of contacts each mounted in one of said passages and having a rear portion, and a cable having a jacket and having a plurality of wires in said jacket, said jacket having a front portion stripped away to leave individual wire front portions, said wire front portions each being terminated to a rear portion of one of said contacts, and said jacketed cable extending rearwardly through and out of said rear body passageway, a quantity of potting material lying within said rear body passageway and molded around said wire front portions and contact rear ends and around said cable, wherein:

said front and rear bodies having adjacent largely cylindrical surfaces, with a first of said cylindrical surfaces having a groove;

an O-ring lying in said groove of said first cylindrical surface and being pressed against the other cylindrical surface to form a radial seal between them;

a shell that has front and rear shell portions that respectively surround said front and rear bodies;

said shell has an axis and said shell rear portion has a largely cylindrical shell outside surface;

said shell is molded with at least one ridge that projects radially from said shell outside surface, said ridge lying at only one of two circumferentially opposite sides of said shell, and having a largely circumferential ridge rear portion;

said ridge has opposite side portions that extend forwardly from opposite sides of said ridge rear portion, said ridge rear portion projecting radially outwardly further on average than said ridge side portions.

2. The connector assembly described in claim 1 wherein:

said potting material is elastomeric.

3. An electrical connector assembly comprising:

a connector body assembly which includes a contact holder having an axis and a plurality of longitudinally extending passages extending parallel to said axis, and a lock sleeve that extends around said contact holder and that has a pair of latches in the form of radially outward projections;

a shell that receives said lock sleeve, said shell having a pair of slots in its opposite sides that are each positioned to receive one of said latches;

said lock sleeve has a plurality of pairs of longitudinally-extending slots, each pair of slots forming an arm between them, each arm having front and rear ends that each merges with a rest of said sleeve;

each of said slots having a predetermined average slot width, in a direction circumferential to said axis, and each slot having longitudinal opposite ends that are of greater width than said average slot width.

4. The connector assembly described in claim 3 wherein;

said slot opposite ends are each primarily circular.

5. The connector assembly described in claim 3 wherein:

said enlarged ends of each of said pairs of slots extend primarily towards one another to leave a reduced width at each end of each arm.

6. The connector described in claim 3 wherein:

said lock sleeve is formed of molded plastic, and said projections each has circumferentially-spaced opposite side walls that each extends at a radially outward and rearward incline.

7. The connector described in claim 6 wherein:

said projections each have a rear wall with circumferential opposite ends and a pair of side walls each merging with an end of said rear wall, the rear wall having about the same thickness in an axial direction as said side walls have in a circumferential direction.

8. An electrical connector which has a molded plastic outer shell that has an axis, said connector having contacts with longitudinally spaced contact mating front ends and contact wire terminating rear ends, said shell having a largely cylindrical outer surface, wherein:

said shell outer surface has at least one radially outwardly projecting ridge that extends in a loop with primarily longitudinally-extending opposite ridge sides and with a primarily circumferentially extending rear ridge portion extending between rear ends of said ridge sides.

9. The connector described in claim 8 wherein:

said ridge sides have front ends, and said rear ridge portion projects radially further from said shell axis than said ridge side front ends.

10. The connector described in claim 9 wherein:

said ridge sides are circumferentially spaced by about two centimeters, whereby to readily receive a person's thumb largely between said ridge sides.

11. The connector described in claim 8 wherein:

said ridge lies at a first side of said shell outer surface, and said shell outer surface has a second side which is diametrically opposite said first side and which is devoid of a ridge, whereby to indicate the orientation about said axis at which said shell should be grasped.

12. The connector described in claim 8 wherein:

said shell outer surface has a first side with a plurality of radially projecting ridge elements, each extending in a loop with one loop of one ridge element lying within another loop of another ridge element.

13. A connector assembly comprising:

a shell with front and rear shell portions and a longitudinally-extending axis;

front and rear bodies with portions thereof lying respectively in said front and rear shell portions, said front body having a plurality of contact-holding longitudinally-extending passages and said rear body having a cable-holding passageway;

a plurality of contacts each lying in one of said passages and having a mating front end and a wire connecting rear end;

a cable having a plurality of wires connected to said contact rear ends, said cable extending rearwardly through said passageway and rearwardly of said shell;

said front and rear bodies having respective rear and front ends with largely cylindrical surfaces having threads engaged with each other;

said shell being molded of plastic and having a shell front portion with a largely cylindrical surface and having at least one ridge projecting from said surface, said ridge extending in a loop with opposite loop sides extending largely longitudinally and with a rear loop end at the rear of said shell front portion;

an O-ring that lies between said largely cylindrical surfaces;

a quantity of potting material lying in said passageway and around the cable therein.

14. An electrical connector assembly comprising:

front and rear bodies, said front body including a contact-holding portion with a plurality of contact-receiving passages and including a rear portion with an external thread;

said rear body having a rear portion forming a cable-receiving passageway and having a front portion that forms an internal thread that is threadably connected to said thread of said front body;

a plurality of contacts each mounted in one of said passages and having a rear portion;

a cable having a jacket and having a plurality of wires in said jacket, said jacket having a front portion stripped away to leave individual wire front portions, said wire front portions each being terminated to a rear portion of one of said contacts, and said jacketed cable extending rearwardly through and out of said rear body passageway;

a quantity of potting material lying within said rear body passageway and molded around said wire front portions and contact rear ends and around said cable;

said front and rear bodies having adjacent largely cylindrical surfaces lying adjacent to said threads, with a first of said cylindrical surfaces having a groove;

an O-ring lying in said groove of said first cylindrical surface and being pressed against the other cylindrical surface to form a radial seal between them;

said rear body front portion forms an internal thread and said front body rear portion forms an external thread;

said front body has a sleeve-shaped part that forms said external threads and a cylindrical inner surface and said contact holding portion of said front body has a contact holder with a rear end lying within and radially spaced from said cylindrical inner surface of said sleeve-shaped part to leave a gap between them, a wire-surrounding sleeve that has a front portion that lies in said gap and closely within said sleeve-shaped part of said front body portion and closely around said cylindrical rear part of said contact holding portion, to thereby minimize leakage of potting material.

15. A method for assembling an electrical connector assembly that has a first body with a contact-holding part that forms a plurality of passages extending in front and rear directions and a plurality of contacts that lie in said passages, said contacts having rear contact ends terminated to wires of a cable that trails through and rearward of a passageway in a second body, said contact-holding part projecting rearwardly into said second body passageway and leaving a gap between an outside of a rear portion of the contact-holding part and the inside of said second body, the second body having a front portion with a threaded second cylindrical surface that is threadably engaged with a threaded first cylindrical surface of a rear portion of the first body, comprising:

applying a potting material to said passageway of said second body to fill it;

establishing an O-ring to seal said first and second bodies to each other at a location adjacent to said threads to stop the outflow of flowable potting material;

establishing a wire-surrounding sleeve inside said passageway of said second body, with a front portion of said sleeve lying in said gap between said contact-holding part and said second body;

said first body includes a contact-holding part that forms said contact-holding passages and that projects rearwardly into said second body passageway, with a gap between an outside of a rear portion of said contact-holding part and the inside of said second body, and including establishing a wire surrounding sleeve inside said passageway of said second body, with a front portion of said sleeve lying in said gap between said contact-holding part and said second body.

* * * * *